US010068521B2

(12) United States Patent
Kaehler et al.

(10) Patent No.: US 10,068,521 B2
(45) Date of Patent: Sep. 4, 2018

(54) PARTIAL MEMORY METHOD AND SYSTEM FOR BANDWIDTH AND FRAME RATE IMPROVEMENT IN GLOBAL ILLUMINATION

(71) Applicant: Google Inc., Mountain View, CA (US)

(72) Inventors: John Kaehler, Mountain View, CA (US); Yi Tao, Mountain View, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/476,643

(22) Filed: Mar. 31, 2017

(65) Prior Publication Data

US 2018/0174509 A1 Jun. 21, 2018

Related U.S. Application Data

(60) Provisional application No. 62/436,198, filed on Dec. 19, 2016.

(51) Int. Cl.

| | |
|---|---|
| ***G09G 5/10*** | (2006.01) |
| ***G09G 3/3225*** | (2016.01) |
| ***G09G 5/00*** | (2006.01) |

(52) U.S. Cl.

CPC ..... *G09G 3/3225* (2013.01); *G09G 5/001* (2013.01); *G09G 2300/0426* (2013.01); *G09G 2300/0842* (2013.01); *G09G 2310/0291* (2013.01); *G09G 2310/08* (2013.01); *G09G 2320/0233* (2013.01); *G09G 2320/0626* (2013.01); *G09G 2360/18* (2013.01)

(58) Field of Classification Search

CPC ..... G09G 3/3225; G09G 5/001; G09G 2320/0233; G09G 2320/0626; G09G 2300/0426; G09G 2300/0842; G09G 2360/18; G09G 2310/0291; G09G 2310/08

See application file for complete search history.

(56) References Cited

U.S. PATENT DOCUMENTS

| | | | |
|---|---|---|---|
| 6,249,269 | B1 | 6/2001 | Blalock et al. |
| 7,375,701 | B2 | 5/2008 | Covannon et al. |
| 8,786,529 | B1 | 7/2014 | Chavez et al. |

(Continued)

FOREIGN PATENT DOCUMENTS

| | | |
|---|---|---|
| EP | 2472499 | 7/2012 |

OTHER PUBLICATIONS

U.S. Appl. No. 15/463,097, filed Mar. 20, 2017, listing Yi Tao and John Kaehler as inventors, entitled, "Display Panel With Concurrent Global Illumination and Next Frame Buffering,", 56 pages.

(Continued)

*Primary Examiner* — Rodney Amadiz

(57) ABSTRACT

A pixel driving technique for an organic light emitting diode (OLED) display. A frame of image data is shifted into an OLED panel and activated for global illumination. During the time period of global illumination for the frame of image data, pixel data for a next frame of image data is buffered in a partial memory. After the period of global illumination for the frame of image data, the next frame of image data being buffered in the partial memory is read out of partial memory to the OLED panel and updates the previous frame of pixel data with the new pixel data.

20 Claims, 7 Drawing Sheets

(56) References Cited

U.S. PATENT DOCUMENTS

| | | | | |
|---|---|---|---|---|
| 2010/0156964 | A1 | 6/2010 | Masuda | |
| 2011/0261037 | A1 | 10/2011 | Govil et al. | |
| 2012/0113077 | A1 | 5/2012 | Kang | |
| 2012/0146999 | A1 | 6/2012 | Hwang | |
| 2013/0215326 | A1 | 8/2013 | Sato | |
| 2013/0249883 | A1 | 9/2013 | Hwang | |
| 2014/0078267 | A1 | 3/2014 | Sato | |
| 2014/0139566 | A1 | 5/2014 | Han | |
| 2014/0346475 | A1 | 11/2014 | Cho et al. | |
| 2015/0029218 | A1 | 1/2015 | Williams et al. | |
| 2015/0029239 | A1 | 1/2015 | Park | |
| 2016/0210906 | A1 | 7/2016 | In et al. | |
| 2016/0284265 | A1* | 9/2016 | Prache | G09G 3/3208 |
| 2017/0309245 | A1* | 10/2017 | Richards | G09G 3/3688 |
| 2018/0033365 | A1 | 2/2018 | Zhang et al. | |

OTHER PUBLICATIONS

International Search Report and Written Opinion dated Nov. 10, 2017 for PCT Application No. PCT/US2017/052547, 15 pages.
Combined Search and Examination Report dated Mar. 19, 2018 for GB Application No. GB1715629.0, 8 pages.
Non-Final Office Action dated Apr. 2, 2018 for U.S. Appl. No. 15/463,097, 42 pages.

* cited by examiner

PARTIAL MEMORY METHOD AND SYSTEM FOR BANDWIDTH AND FRAME RATE IMPROVEMENT IN GLOBAL ILLUMINATION

CROSS-REFERENCE TO RELATED APPLICATIONS

The present application claims priority to U.S. Patent Application Ser. No. 62/436,198, entitled "Brightness and Frame Rate Improvement of Virtual Reality Head-Mounted OLED Display" and filed on 19 Dec. 2016, the entirety of which is incorporated by reference herein. The present application is related to U.S. patent application Ser. No. 15/463,097, entitled "Display Panel With Concurrent Global Illumination and Next Frame Buffering", to Yi Tao et al., and filed on 20 Mar. 2017, which is herein incorporated by reference for all purposes.

BACKGROUND

Technical Field

The present disclosure relates to electronic displays, and more particularly to electronic displays for virtual reality systems.

Description of the Related Art

Virtual Reality (VR) uses computer technology to simulate actual real-time environments with which a user may interact. VR technology may be used in a broad range of applications to provide real time experiences. For example, without limitation, VR applications may include gaming, movies, vehicle or other simulations, training programs, and head-mounted displays and other applications involving moving action and frequent content changes. Accordingly, providing a realistic VR experience when using a VR application may require fast screen updates of data and increased brightness or illumination. In order for a VR display to provide a realistic VR experience for a user, VR displays may use organic light emitting diodes (OLED) which provide advantages including, without limitation, short switching time for a fast electronic response, large color gamut, high contrast ratio, low latency, and excellent black state when the OLEDs are in a state when they are not emitting light. In order to achieve a faster update of screen data for OLED VR displays, the video subsystem of the display may need to increase the frame rate. The frame rate corresponds to the number of times the display changes (e.g., in frames per second (FPS)) at the corresponding video subsystem.

OLED VR displays, include, for example, without limitation, mobile phones, MP3 players, monitors, and head mounted display. The OLED VR head-mounted display (HMD) typically requires a high bus bandwidth to write and read the fast-moving pixel data to the display. However, the bandwidth and frame rate may be limited by the sequential method of operation of a conventional global illumination method.

BRIEF DESCRIPTION OF THE DRAWINGS

For a better understanding of the disclosure and the various embodiments described herein, reference is now made to the following brief description, taken in connection with the accompanying drawings and detailed description, which show at least one exemplary embodiment.

DETAILED DESCRIPTION

The present disclosure provides an organic light emitting diode (OLED) display method and system that allows frame data input to occur in parallel with a process of global illumination of the display. During an illumination time period of image data for a panel, new pixel data for a subsequent (next) image may begin to be loaded into a partial memory within a time period that is simultaneous or in parallel with the illumination time period for the first image data. In this disclosure, the process of beginning to load a subsequent frame of pixel data corresponding to another image while simultaneously activating global illumination of a current panel of image data is referred to as the buffering of image data. Buffering allows a portion of the incoming pixel data to be stored locally in the display driver and then retrieved when the panel is ready to receive the data. Data is retrieved from the buffer while additional incoming pixel data is continually downloaded to keep the buffer full.

Image data is received and buffered in a partial memory until the illumination time period of the previous frame of image data of the display panel ends. At the end of the illumination period, the image data for the next frame that is buffered in partial memory begins to be read out to the display panel. Incoming image data that corresponds to the frame of data that is currently being read out of partial memory continues to be received to the partial memory and is appended to the data already in partial memory and read out to the display panel in sequence. Once the display panel fills with pixel data, a period of global illumination of the pixel data is activated while incoming pixel data for the next frame is buffered into partial memory.

Figure 1:
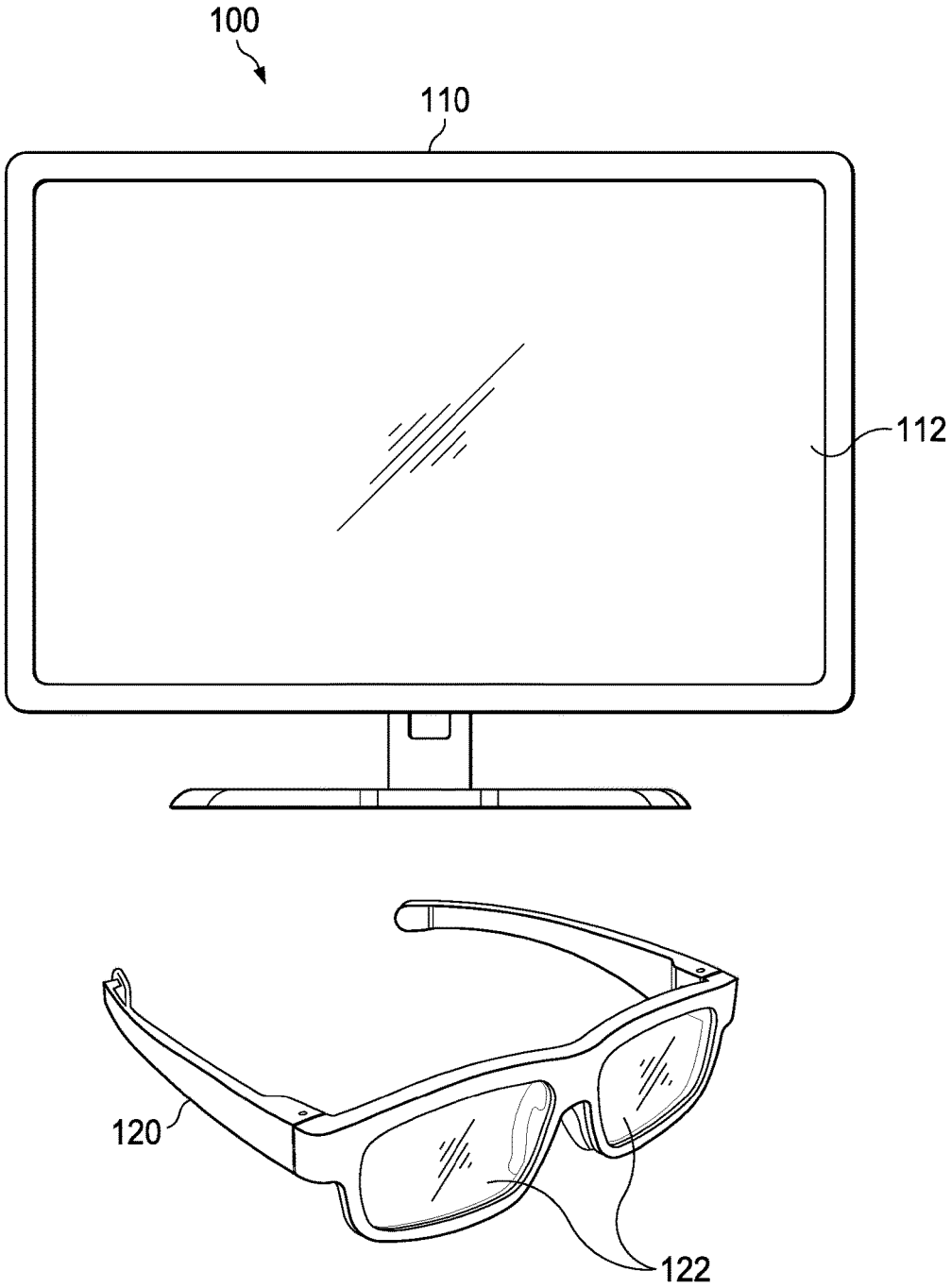
FIG. 1 is a diagram of a head mounted display (HMD) system and a display panel system in which illustrative embodiments of the disclosure may operate.

Turning to FIG. 1, diagram 100 discloses systems in which illustrative embodiments of the disclosure may operate. In one embodiment, display 110 may be an OLED display on which images may be viewed on a screen 112. Screen 112 may include a plurality of images arranged in a pixel array which may be viewed as an image on screen 112. In an embodiment, the pixel array may be video data. In another embodiment, the pixel array may be pattern data. A memory may be associated with the display screen to receive and store the image data until it is illuminated on the screen 112. In another embodiment, head mounted display (HMD) 120 may include an embedded OLED display screen 122 and display driver (not shown). The display driver may be associated with memory that is used to store a portion of image data that is less than a full frame of image data. In this disclosure, the amount of memory used to store a portion of image data that is less than a full frame of image data is referred to as a partial memory or partial frame memory. Display screen 122 may be used to display image data, such as, without limitation, video image data one frame at a time. As one frame of image data is globally illuminated on the display screen 122 for the user, another pixel array of image data may simultaneously, in parallel, begin to be loaded into partial memory. The display screen is updated with the pixel data stored in partial memory at the end of the global illumination.

Figure 2:
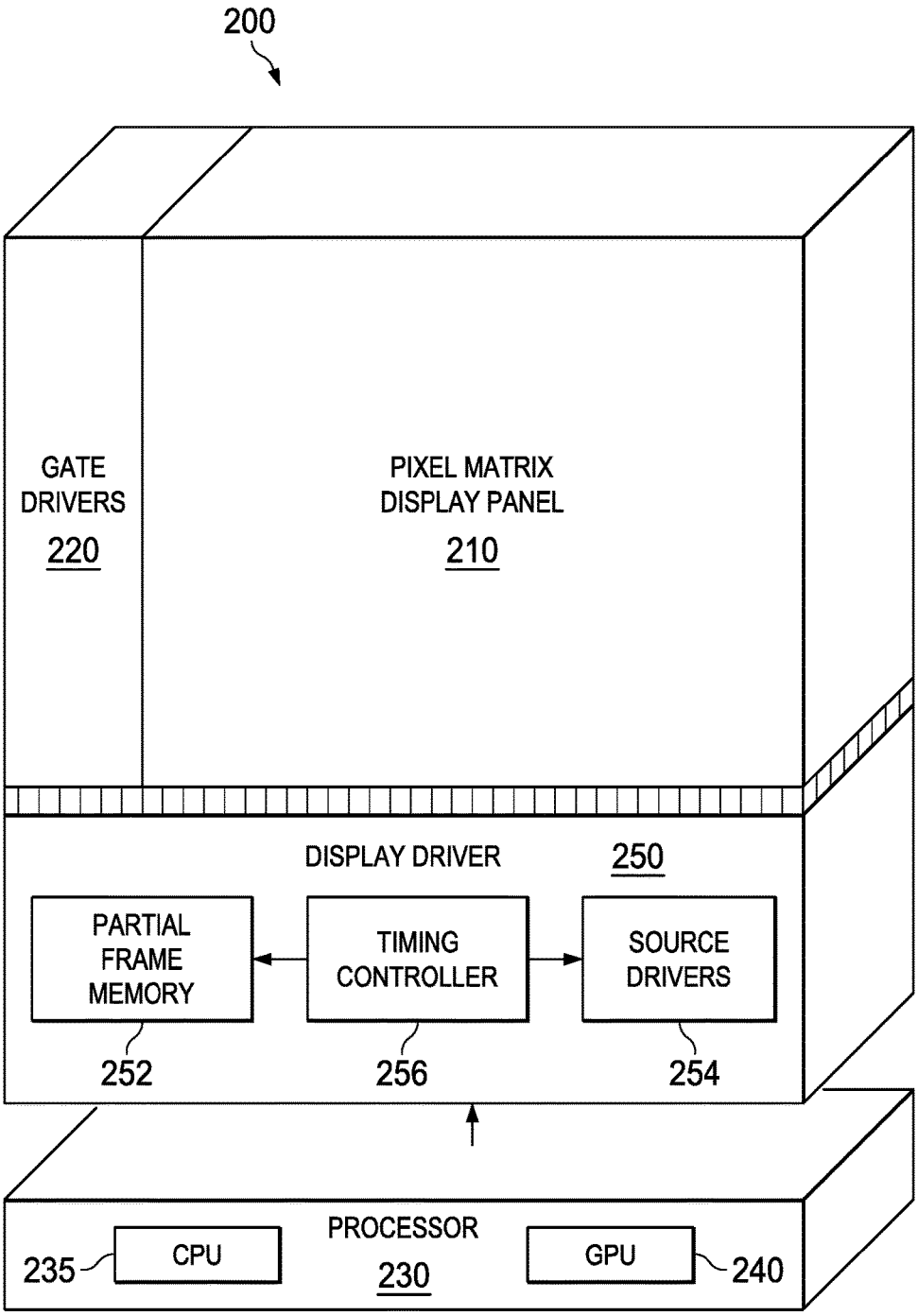
FIG. 2 is a diagram of a display system with a partial memory architecture in accordance with an illustrative embodiment of the disclosure.

Turning next to FIG. 2, an illustrative diagram of a display system 200 with a partial memory architecture in accordance with an illustrative embodiment of the disclosure is illustrated. Display system 200 includes a pixel matrix display panel 210 in which a plurality of pixels may be arranged in rows and columns to form a display image. In an illustrative embodiment, the pixel matrix display panel 210 may be an OLED display panel. Other similar types of panels may be used as would be evident to one skilled in the art. Gate drivers 220 may be used to shift a sequence of pixels for a frame into display panel 210. A display driver 250 is provided to the display panel 210. Display driver 250 includes a timing controller 256 which may control timing of pixel data transfers for the display driver 250.

Display driver 250 also includes partial frame memory 252 that buffers a certain amount of incoming pixel data for another frame of image data while pixel data for a current frame of image data is activated for illumination at the pixel matrix display panel 210. Partial frame memory 252 buffers the image data that refreshes the display panel. The amount of image data the partial frame memory 252 buffers is an amount of incoming pixel data that is less than a full frame of data. Processor 230 may be an application processor that provides the display driver 250 with image data and control signals associated with the image data. In one embodiment, processor 230 may comprise a central processing unit (CPU) 235 and a graphics processing unit (GPU) 240. The CPU 235 may control the operation of processor 230 to transmit image data from external memory (not shown) to display driver 250. The CPU 235 may also control the operation of GPU 240 to process image data from an external memory (not shown) for transmission to display driver 250.

In operation, processor 230 drives pixels to the partial frame memory 252 of display driver 250 to be input to pixel matrix display panel 210. Input pixel data is continuous and does not stop. During a global illumination time period, no incoming pixel data may be transferred to the pixel matrix display panel 210. Any incoming pixel data for the next frame of data during the global illumination time period may be stored in partial frame memory 252. At the conclusion of the global illumination time period, pixel data for a new frame of data updates the pixel matrix display panel 210 with pixel data stored in partial frame memory 252 during the global illumination time period. It is important to note that partial frame memory 252 may not be designed to hold a full frame of pixel data. The size of the partial memory may be based on the resolution of the display, the refresh rate and the bandwidth limit of the incoming data.

The illustration of the display system architecture of FIG. 2 is not meant to imply physical or architectural limitations to the manner in which different embodiments may be implemented. Other components in addition and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments. For example, in some illustrative embodiments of FIG. 2, processor 230 and display driver 250 may be implemented within one module, or system on chip. In other illustrative embodiments, display panel 210 and display driver 250 may be integrated by one module or a plurality of separate modules. In still some other illustrative embodiments, display system 200 may be implemented as a personal computer, such as the implementation illustrated by display system 110 of FIG. 1, or a HMD such as that illustrated by the HMD 120 of FIG. 1.

Figure 3:
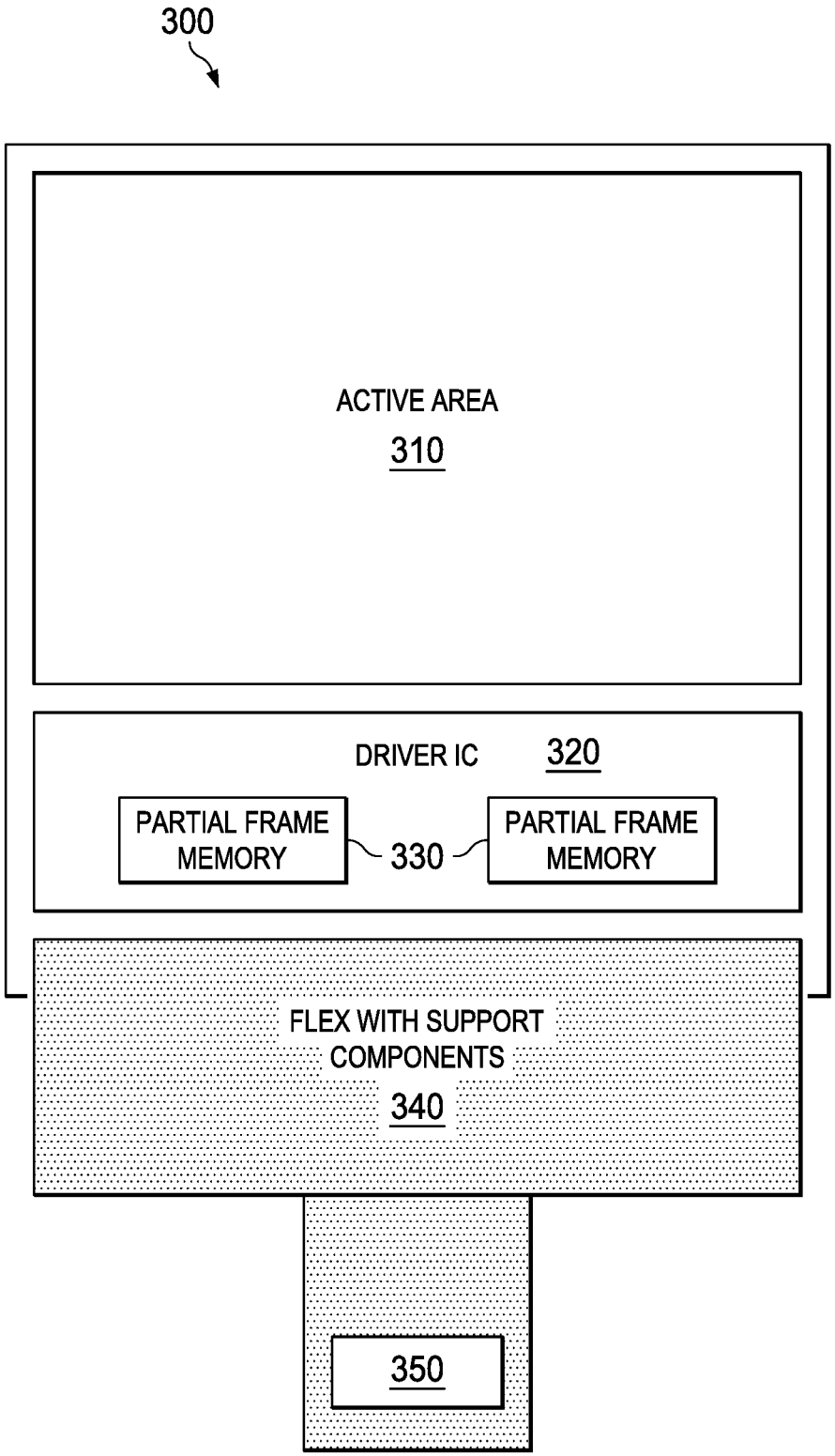
FIG. 3 is an illustrative VR display incorporating the partial memory architecture according to an illustrative embodiment of the disclosure.

In FIG. 3, a VR device 300 that incorporates the partial memory architecture of FIG. 2 is illustrated. In one embodiment, VR device 300 may be a HMD. In FIG. 3, VR device 300 includes a viewing area 310, a display driver integrated circuit (IC) 320, a Flexible Printed Circuit (FPC) with support components 340 and a connector 350 to an accelerated processing unit (APU) (not shown). FPC with support components 340 provides a connection that bridges the VR device 300 to the main logic board. Connectors may be, without limitation, a board to board connector or a zero-insertion force connector. The support components are for the display driver IC 320 and VR device 300. Support components 340 may include, without limitation, resistors, capacitors, and diodes. In an embodiment, the APU may be a graphics processor unit (GPU) or central processing unit (CPU). For high resolution, the viewing area 310 may be large and/or contain a high number of pixels on the horizontal and vertical axes of the viewing area 310. For example, without limitation, the viewing area may have a resolution of 2880 pixels on a horizontal axis and 2880 pixels on a vertical axis expressed as 2880×2880. Display driver IC 320 may include partial frame memory 330 that stores a partial amount of pixel data of a frame. Partial frame memory 330 may hold a portion of the pixel data that will fill viewing area 310. For example, without limitation, in one illustrative embodiment, a viewing area 310 may be 2880×2880 of pixel data. However, the partial frame memory size may only be 1440×ZZZZ where ZZZZ is significantly less than the vertical height. The illustration of the display system architecture of FIG. 2 is not meant to imply physical or architectural limitations to the manner in which different embodiments may be implemented. For example, in an embodiment, the incoming image data may be compressed. In another embodiment, the memory may be compressed.

Figure 4A:
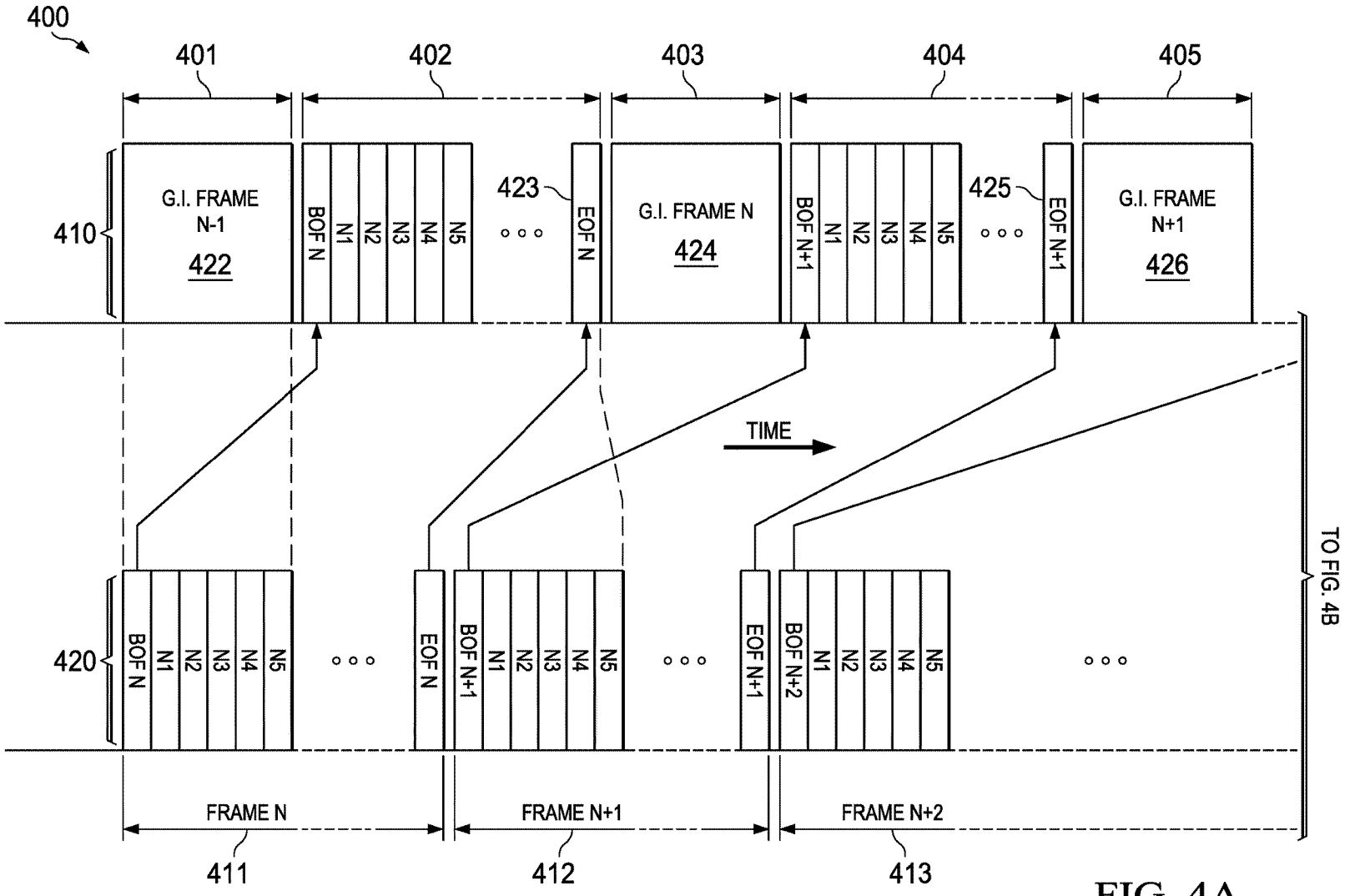
FIGS. 4A and 4B illustrate a schematic of a sequence of operation in an implementation of the partial memory architecture of FIG. 2 in accordance with an illustrative embodiment of the disclosure.
Figure 4B:
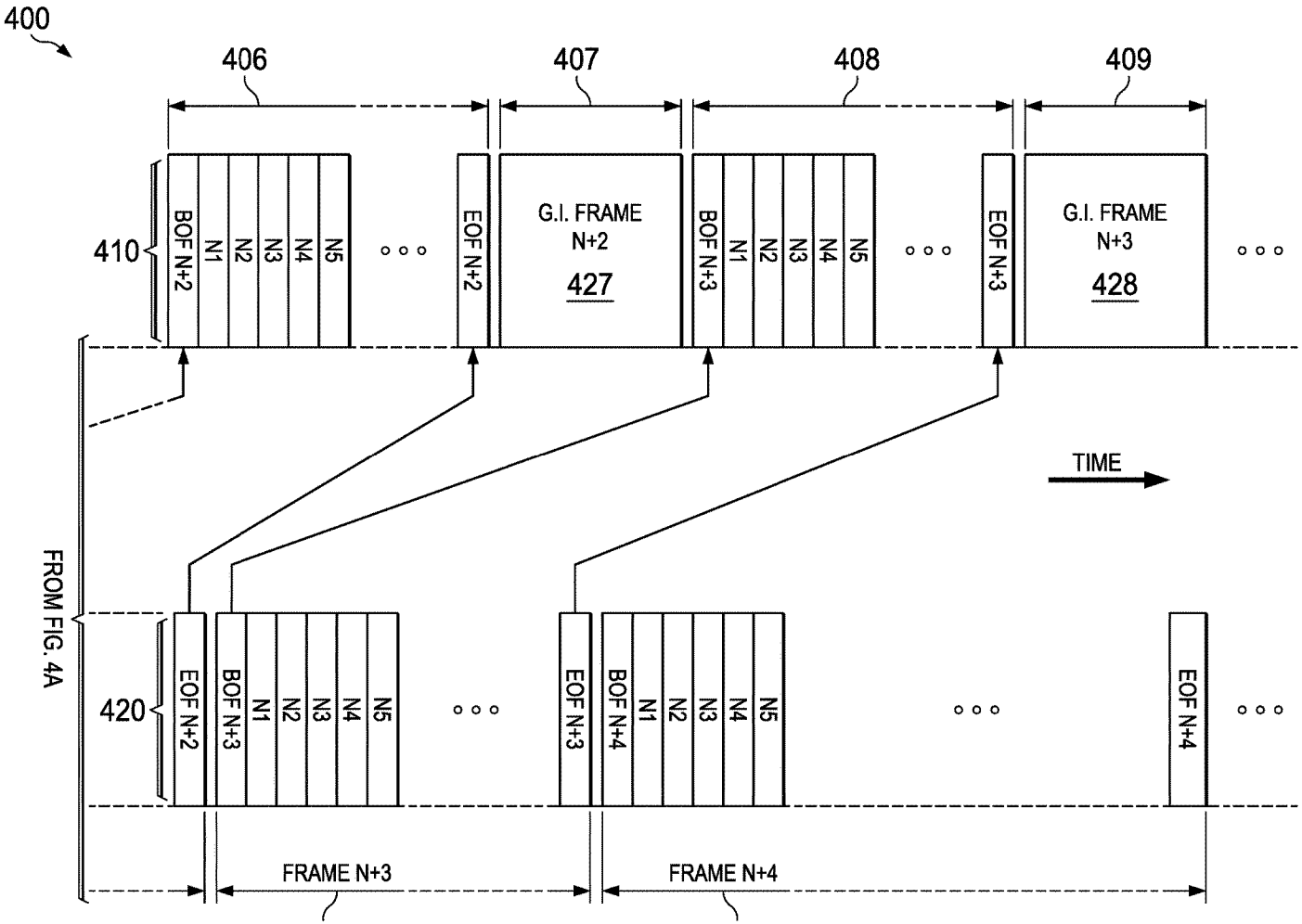

FIGS. 4A and 4B illustrate a schematic of an illustrative sequence of operation in an implementation of the partial memory method in accordance with an illustrative embodiment of the disclosure. To summarize the process, during a global illumination time period, the display panel may be ready to illuminate a previously loaded frame of pixel data for a certain period of time. During the global illumination time, the panel or frame cannot receive any incoming new or updated pixel data. Incoming pixel data would overwrite the existing pixel data being used for global illumination with new data. Consequently, no new pixel data may be written to the panel until the global illumination time is over. The continuous incoming pixel data is written into partial memory or buffered in partial memory until the global illumination time is over.

To illustrate the process, in schematic 400 of the illustrative embodiment of the global illumination partial memory scheme, during time 401, display panel 410 activates global illumination 422 of the pixel data of Frame N−1 (not shown). At a time concurrent to, or about the same as time 401, pixel data for a next frame of data, Frame N 411 may begin to be shifted into partial memory 420 of display panel 410. At the end of the global illumination time 401, pixel data of Frame N 411 that is buffered in partial memory 420 will start to be shifted out of partial memory 420 to display panel 410 during time 402. In some embodiments, at the end of the global illumination time 401, all of the image pixel data of Frame N 411 may not be completely written into partial memory 420.

At the end of time 402, the last pixel of Frame N 411, EOF N 423, is written to display panel 410 and global illumination 424 for Frame N 411 is activated during a time 403. Incoming image data for a frame is continuously being received by the system in the form of pixel data. In one embodiment, the image data may be received directly to the display panel 410 with any image data overflow being stored in partial memory 420. During global illumination 424 for Frame N 411, pixel data for a next frame of data, Frame N+1 412 may be received concurrently, or at a same time, into partial memory 420 during a timeframe parallel to time 403. At the end of time 403, pixel data for Frame N+1 412 buffered in partial memory 420 may begin to be shifted to the display panel 410 during a time 404. When the last pixel of Frame N+1 425 is written to display panel 410, global illumination 426 for Frame N+1 412 is activated during a time 405.

The process continues for incoming pixel data such as, without limitation, pixel data for a Frame N+2 413 is written to display panel 410 and global illumination 427 may be activated during a time 407 for Frame N+2 413; pixel data for Frame N+3 414 is written to display panel 410 and global illumination 428 may be activated during a time 409 for Frame N+3 414; pixel data for Frame N+4 415 is written to display panel 410 at a later time (not shown) and global illumination is activated for the frame pixel data thereafter. Pixel data corresponding to each frame, such as, for example, Frame N+X where X is a positive integer, is received into a partial memory 420 and buffered there during activation of global illumination for a complete frame previously written to the display panel 410. The pixel data for the next frame buffered in partial memory 420 is read out to the display panel 410 at the end of each global illumination time period.

Figure 5:
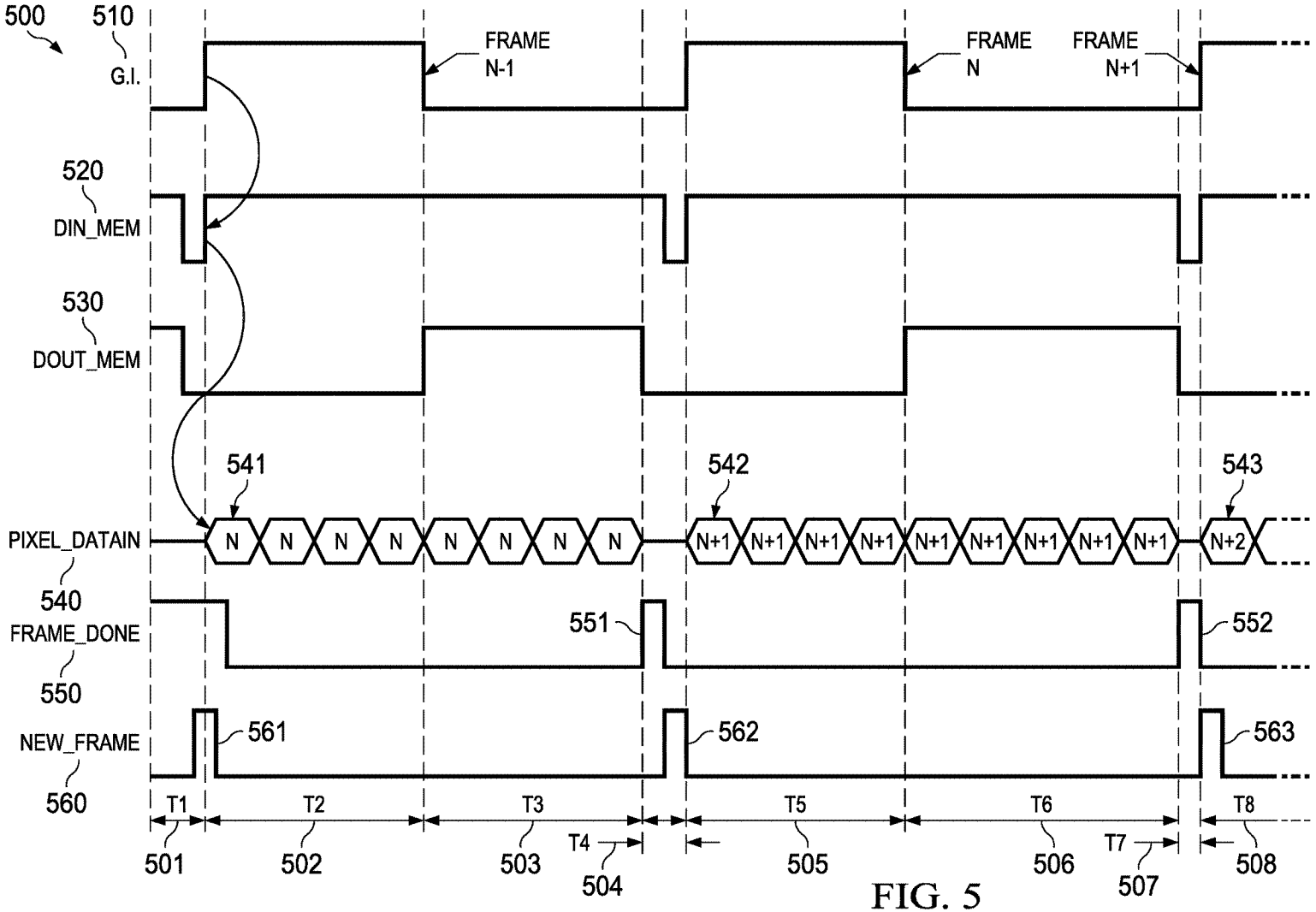
FIG. 5 is a timing diagram of the illustrative sequence of operation of FIG. 3 in accordance with an illustrative embodiment of the disclosure.

FIG. 5 is an illustrative timing diagram 500 of the illustrative sequence of operation in FIG. 4 in accordance with an illustrative embodiment of the disclosure. The timing, signals and waveforms as illustrated, which may represent the function of system components, are not meant to imply physical or architectural limitations to the manner in which different advantageous embodiments may be implemented. Other signals or timing variations in addition and/or in place of the ones illustrated may be used. Some component signals may be unnecessary in some advantageous embodiments. Also, the blocks are presented to illustrate some functional components. One or more of these blocks may be combined and/or divided into different blocks when implemented in different advantageous embodiments.

In summary, in FIG. 5, timing diagram 500 illustrates incoming image pixel data to a system during a global illumination time to increase throughput. A global illumination period starts at a time T1 501. During T1 501, pulse 561 of New_Frame 560 signals that a new frame of data is ready to be written to partial memory during the global illumination period. During time T2 502, global illumination signal, G.I. 510, is active to indicate illumination of an image and data in partial memory signal, Din_Mem 520, activates to indicate image data, Pixel_Datain 540, for a new frame N 541 being written into partial memory concurrently or at the same time as the illumination period. During time T2 502 while G.I. 510 is active, no image data is written from memory to the display panel as indicated by an inactive data out from partial memory signal, Dout_Mem 530. At about time T3 503, the global illumination time period ends and Dout_Mem 530 is activated to indicate that the image data of Frame N 541 buffered in memory is now being written to the display panel for global illumination. At about a time T4 504, completion of the image data for Frame N 541 may be indicated by pulse signal 551 of Frame_Done 550. A new frame of data may now be ready to be loaded into partial memory during a global illumination period as indicated by pulse signal 562 of New_Frame 560. At about a time T5 505, the global illumination for frame N 541 is activated and the pixel data for the new frame of data, Frame N+1 542 begins to be buffered in a partial memory as indicated by the active signal Din_Mem 520. At about a time T6 506, global illumination for Frame N 541 is complete and the new Frame N+1 542 being buffered in partial memory begins to be read out of partial memory to the display panel as indicated by Dout_Mem 530. The sequence of global illumination, pixel data buffering in partial memory, and image data readout from partial memory to display panel continues at a time T7 507 when all the pixel data corresponding to Frame N+1 542 has been read out of partial memory to the display panel as signaled by pulse signal 552 of Frame_Done 550 and Dout_Mem 530. Global illumination of the Frame N+1 542 image data may be activated at a time T8 508 as indicated by signal G.I. 510 as a new frame of pixel data Frame N+2 543 starts to be buffered into partial memory as indicated by an active Din_Mem 520 and pulse signal 563 of New_Frame 560.

After a global illumination time ends, the pixel data stored in partial memory during the time global illumination is activated may be read out of the partial memory to the display panel. In one embodiment, it may be that the remaining pixel data for a frame may be read directly to the display panel and bypass the partial memory until global illumination is active. In another embodiment, it may be that the remaining pixel data continues to be input to partial memory and the pixel data is read out to the panel from the partial memory in the same sequential data order in which it was input.

Figure 6:
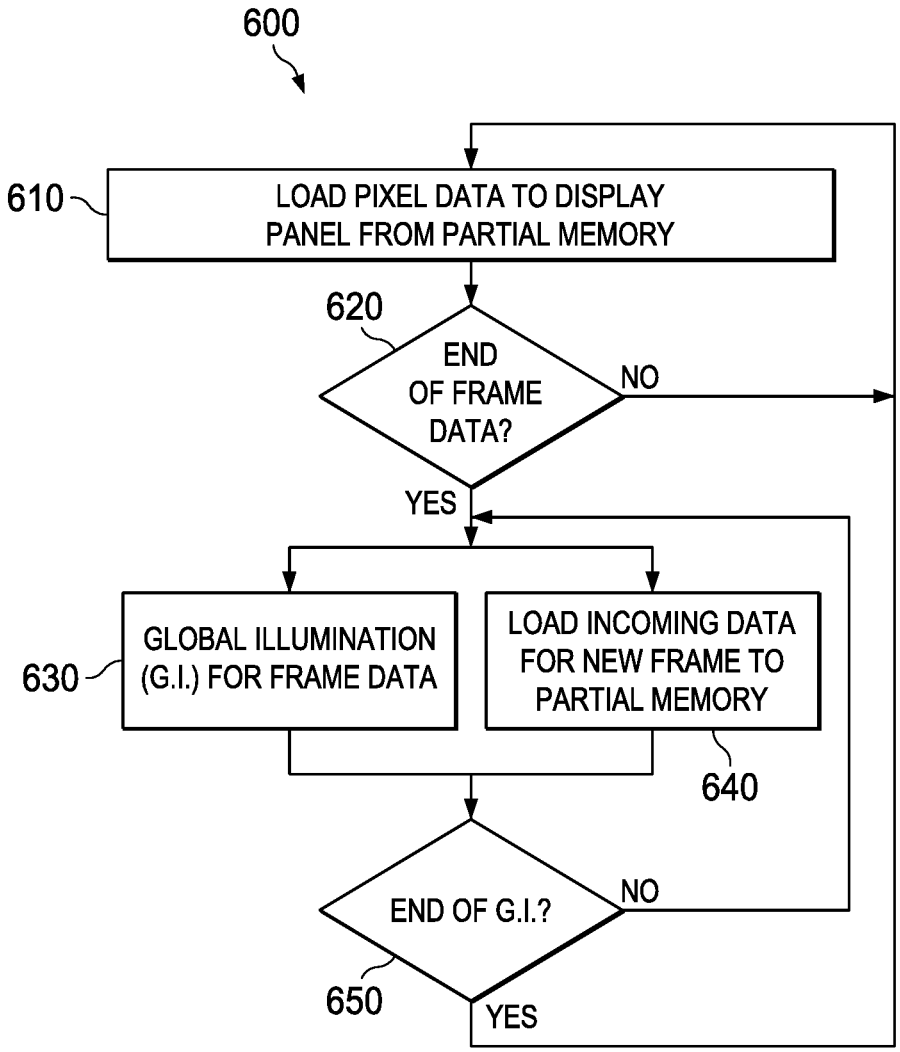
FIG. 6 illustrates a flowchart of the operation of the partial memory method implementation in accordance with an illustrative embodiment of the disclosure.

Turning next to FIG. 6, a flowchart 600 of the operation of the partial memory method implementation in accordance with an illustrative embodiment of the disclosure is illustrated. At 610, pixel data is written from a partial memory to a display panel. At 620, it is determined whether the end of pixel data for the frame has been read out from partial memory to the display panel. In response to the end of frame pixel data being reached, global illumination of the display panel activates at 630 for the frame data and the incoming pixel data for a new frame of data is written and buffered in partial memory at 640. Incoming pixel data for the new frame of data is written and buffered to partial memory at 640 until it is determined at 650 that the global illumination of 630 has ended. In response to a determination of the end of global illumination at 650, the incoming pixel data for the new frame of data is written from partial memory to the display panel at 610. In response to a determination at 650 that global illumination is not complete, the pixel data for a new frame continues to be written to partial memory.

Although an illustrative implementation of one or more embodiments are provided herein, the description is not to be considered as limiting in scope of the embodiments described herein. The disclosure may be implemented using any number of techniques, whether currently known or in existence. The disclosure should in no way be limited to the illustrated implementations, drawings, and techniques illustrated and described herein, which may be modified within the scope of the appended claims along with a full scope of equivalence. It should also be appreciated that for simplicity and clarity of illustration, where considered appropriate, the reference numerals are repeated among the figures to indicate corresponding or analogous elements.

The various embodiments of the present disclosure illustrate how the implementation of partial memory in displays, particularly in virtual reality sized displays, such as, without limitation, head-mounted displays, is used to increase the throughput and bandwidth of incoming image data and the resolution of the display. A partial memory configuration as described in the present disclosure allows a system to achieve the highest bandwidth possible and additionally maximizes the refresh rate of a screen of data. This allows optimal system performance to be achieved by a system having a display with a fixed frame rate and a low bandwidth input or a system with a display having a high frame rate but fixed bandwidth input.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein.

The embodiment or embodiments selected are chosen and described in order to best explain the principles of the embodiments, the practical application, and to enable others of ordinary skill in the art to understand the disclosure for various embodiments with various modifications as are suited to the particular use contemplated. For example, the various elements or components may be combined or integrated in another system or certain features may be omitted or not implemented.

Also, techniques, systems, and subsystems are described and illustrated in the various embodiments as discrete or separate may be combined or integrated with other systems, modules, or techniques without departing from the scope of the present disclosure. Other items shown or discussed as coupled or directly coupled or communicating with each other may be directly coupled or communicated through some other interface, device or immediate component whether electrically, mechanically, or otherwise. Other examples of changes, substitutions, and alterations are ascertainable by one skilled in the art could be made without departing from the spirit and scope herein.

What is claimed is:

1. A method of driving a display comprising:

activating global illumination of a first frame of image data during a first time period;

buffering image data for a second frame of image data incoming to a display panel to a memory during the first time period; and writing image data for the second frame of image data to the display panel during a second time period immediately following the first time period.

2. The method of claim 1, wherein the activating and the buffering occur concurrently.

3. The method of claim 1, wherein the writing comprises transmitting the buffered image data from the memory to the display panel.

4. The method of claim 1, wherein the writing comprises transmitting incoming image data from the memory to the display panel.

5. The method of claim 4, further comprising:

at a last line of the incoming image data being written to the display panel, activating global illumination for the second frame of image data during a third time period, wherein the third time period is immediately following the second time period; and buffering image data for a third frame incoming to the display panel to a memory during the third time period; and writing the buffered third frame image data and incoming third image data for the third frame to the display panel during a fourth time period immediately subsequent to the third time period.

6. The method of claim 5, wherein activating global illumination comprises: operating a display panel to illuminate at a same time all light emitting diodes corresponding to pixel data in the first frame of data.

7. The method of claim 6, wherein the activating and the buffering occur in parallel.

8. The method of claim 1, wherein the memory is a partial memory.

9. The method of claim 1, wherein the image data is one of video data and pattern data.

10. The method of claim 1, wherein the display panel is an organic light emitting diode (OLED) display.

11. A display system comprising:

a display panel comprising an array of pixels;

a display driver to transmit image data to the display panel;

a timing controller controlling loading of image data from the display driver to the pixel array; and memory associated with the timing controller that holds a partial frame of data for loading to the display panel; wherein the timing controller activates a global illumination time period of a first frame of image data during a first time period and at a same time writes incoming image data for a second frame of image data to a buffer in a memory during the first time period.

12. The display system of claim 11, wherein the memory associated with the timing controller receives incoming image data during the global illumination time period.

13. The display system of claim 11, further comprising a processor that provides the display driver with image data and control signals.

14. The display system of claim 13, wherein the processor comprises a central processing unit and a graphics processing unit.

15. The display system of claim 11, wherein the memory associated with the timing controller is a partial memory.

16. The display system of claim 15, wherein the partial memory is an amount of memory that is less than a full frame of image data.

17. The display system of claim 15, wherein the partial memory has a capacity that is based on at least one of a resolution of the display panel, a refresh rate, and a bandwidth of the incoming data.

18. The display system of claim 11, wherein the display panel is an organic light emitting diode (OLED) display.

19. The display system of claim 11, wherein the image data is one of video data or pattern data.

20. The display system of claim 11, wherein the loading of image data is continuous.

* * * * *